US005676450A

United States Patent [19]

Sink et al.

[11] Patent Number: 5,676,450

[45] Date of Patent: Oct. 14, 1997

[54] STIMULUS RESPONSIVE SOUND/LIGHT AMUSEMENT ASSEMBLY

[76] Inventors: Charles Sink, 1230 Trivoli La., Simi Valley, Calif. 93065; Jefferey Corsiglia, 6142 Via Escondido Dr., Malibu, Calif. 90265; Lawrence Aledort, 24624 park Granada, Calabasas, Calif. 91302

[21] Appl. No.: 572,316

[22] Filed: Dec. 14, 1995

[51] Int. Cl.[6] ..... F41G 1/34

[52] U.S. Cl. ..... 362/112; 446/406

[58] Field of Search ..... 362/112, 186; 446/405, 406; 42/54

[56] References Cited

U.S. PATENT DOCUMENTS

| | | | |
|---|---|---|---|
| 3,380,305 | 4/1968 | Charell | 73/379 |
| 3,436,076 | 4/1969 | Barthol | 273/26 |
| 4,586,715 | 5/1986 | Scolari et al. | 362/112 |
| 5,138,535 | 8/1992 | Aragon, Jr. | 362/102 |
| 5,346,418 | 9/1994 | Arad | 446/405 |
| 5,412,548 | 5/1995 | Yee | 362/186 |

*Primary Examiner*—Carroll B. Dority
*Attorney, Agent, or Firm*—Robert W. Mulcahy

[57] ABSTRACT

Disclosed is a motion or impact responsive amusement device assembly comprising (1) a light transparent chamber; (2) a light source in communication with said chamber; (3) an impact or motion sensitive member within the amusement device to activate a control circuit to activate a flash unit which illuminates the chamber to effect a "light pipe" effect. The assembly is particularly effective in producing "laser" light effects in toys in the form of guns, sports equipment (baseball bats), military equipment (grenades), and batons (magic wands).

4 Claims, 4 Drawing Sheets

STIMULUS RESPONSIVE SOUND/LIGHT AMUSEMENT ASSEMBLY

FIELD OF THE INVENTION

The present invention relates to illuminable electronic devices. More particularly this invention is directed to an impact actuated sound/light toy assembly. Even more particularly the invention is directed to a toy assembly comprising a light-transparent encasement or chamber having a light source, an impact or motion sensing member within the chamber housing which generates an electrical signal to activate a control circuit to trigger a flash unit to illuminate the housing.

DESCRIPTION OF THE BACKGROUND ART

Presently, toys and other amusement items are commercially available which emit sound and light synchronously upon impact or actuation. These devices simulate futuristic space age laser ray effects particularly when used in toy guns. Heretofore most of these impact responsive sound/light toys required heavy or expensive components to manufacture such toy or amusement items. Moreover the synchronization of light generation with sound and/or impact in such devices has been less than satisfactory in rendering the futuristic laser effect, particularly in toys such as guns. The present invention is directed to an amusement or entertainment assembly which employs relatively simple sound and electronic components. These components enable the production of improved impact or actuation responsive "laser" light generating amusement or toy devices without substantially increasing their weight, size or cost of manufacture. The present assembly is particularly effective and useful in impact responsive toy devices.

The present invention is based on the discovery that a flash bulb unit positioned in comunnication with an elongated hollow channel produces a device which is capable of generating an amplified "laser" or "light pipe" effect. The device takes advantage of presently available high intensity flash lamps in combination with hollow tubes or conduits to render a "light pipe" or "laser" effect upon activation of the flash lamp.

SUMMARY OF THE INVENTION

It has been found that a simple high intensity flash bulb unit when used in an enclosed transparent hollow interior, channel or chamber in combination with (i) an impact or motion sensing means for bulb activation, (ii) a circuit control means electrically connected between the flash unit light source, and (iii) an internal power source results in a light amplification device which simulates a laser light effect upon impact of the chamber. The flash unit light source is comprised of a high intensity flash bulb, a reflector and a lens target comprised of a light emitting material which collimates or focuses the light originally emanating from the source flash bulb. When this combination of elements is positioned in comunnication with a hollow channel or chamber comprised of light transparent material and an impact is applied to the surface of the chamber, a "laser" light or "light piping effect" is generated throughout the light transparent chamber shell. These components can be particularly effective in impact responsive toy or amusement assemblies comprising (i) a housing or encasement in the form of a toy or entertainment article; (ii) a light transparent hollow chamber; (iii) a high intensity flash lamp light source in combination with a collumating or focusing lens and control circuit all positionally situated in the housing for communication of the flash lamp and lens with the interior of the chamber; (iv) an impact or motion sensitive member in connection with the control circuit for activation of the flash unit whereby flash illumination of the chamber occurs to generate a "laser" or "light pipe" effect. The flash assembly and chamber can be employed in entertainment and amusement devices to simulate a spontaneous "laser" or "light piping" effect. The invention has been found particularly effective in simulating laser effects in toys in the form of guns, sports equipment (eg. baseball bat), military equipment (eg. grenades), and batons (eg. magic wands).

In one embodiment of the present invention the instant inventive assembly is used in a toy gun. The assembly is employed in the barrel potion of the gun which comprises (a) a housing in the in the general shape of a gun having a rear body portion, a central trigger-handle potion, and a front barrel portion which comprises (i) a light transparent hollow tubular chamber; (ii) a high intensity flash unit assembly comprised of a light source in combination with a control circuit and a collimating lens, the assembly being in communication with the interior of the hollow chamber; and (iii) a physical stimulus impact sensing means within the chamber and electrically connected to the control circuit; (b) a trigger actuated striking element in the central potion of the housing for impacting the sensing means in the hollow chamber; and (c) a portable power source in the gun housing, said circuit control means of the flash assembly being electrically connected to the flash lamp source and the power source and responsive to the electrical signal generated by said impact sensing means in response to the striker for energizing said light source to illuminate said chamber.

It has been further found that the distinctive assembly of the present invention can be employed in various other amusement or entertainment devices such as toys in the form of military hardware (i.e. grenades), sports equipment (i.e. baseball bats and footballs), and batons (e.g. magic wands). In all of these items the same inventive assembly can be used in combination with varying shaped hollow interiors, channels, or chambers and different impact sensitive members. For example, in a toy baseball bat the light transparent chamber is an annular bore located in the upper heavier end of the bat body. The impact sensitive element is an inertial switch device that, upon bat movement or impact of the bat with objects, causes electrical contact between the light source and the power source through the control circuit. In this way, when the bat is impacted by a ball, the annular chamber at the end of the bat illuminates a laser like flash or "light pipe" effect. In the case of a football, the hollow interior is in the form of an ellipsoidal shell which encases the assembly, the impact means and the consequent dramatic "laser flash" or "light pipe" effect being actuated by a catch of the thrown ball. And so it is with any toy items employing the present inventive assembly; that is, the shape and form of the light transparent hollow interior, channel, or chamber and the impact sensing means will change according to application of the assembly. The central common elements of any "light pipe" effect toy or entertainment items within the purview of the present invention is the use of a "light pipe" assembly comprising (A) a high intensity flash bulb, (B) a reflector positioned with respect to the lamp, (C) a lens target comprised of a light emitting material; and (D) a hollow interior chamber in communication with the lens target to receive the focused light originally emanating from the source flash bulb.

The present invention is specifically directed to an illuminable amusement device comprising:

a) a light transparent hollow chamber;

b) a light source in communication with the interior of the chamber said light source comprised of (i) a high intensity flash lamp, (ii) a reflector, (iii) a control circuit electrically connected to the lamp and (iv) a collimating lens to focus emanating light into the chamber;

c) sensing means electrically connected to the control circuit and located within the chamber said means being responsive to physical stimulus on the exterior of the amusement device; and d) a portable power source electrically connected to the control circuit and responsive to the electrical signal generated by said physical stimulus sensing means for energizing said light source to illuminate the chamber.

The present invention is further directed to a toy device for producing controllable audio and visual effects simulating a fictitious "laser ray" or "light pipe" effect, said device comprising:

a) a body in the general shape of the intended use of the toy article;

b) a light transparent hollow chamber in said body;

c) a light source in communication with the interior of the hollow chamber said light source comprised of (i) a high intensity flash lamp, (ii) a reflector, (iii) a control circuit electrically connected to the lamp and (iv) a lens which collimate or focuses emanating light into the chamber;

d) sensing means electrically connected to the control circuit and located within the chamber said means being responsive to physical stimulus on the exterior of the toy device; and e) portable power means in the toy body electrically connected to the control circuit and responsive to the electrical signal generated by said impact sensing means for energizing said light source to illuminate the chamber.

The instant invention is still further directed to a method for generating "laser ray" or "light pipe" fictitious light in an amusement device comprising:

a) providing a light source in communication with the interior of a transparent hollow shell, said light source comprised of (i) a high intensity flash lamp, (ii) a reflector, (iii) a control circuit electrically connected to the lamp and (iv) a lens which collimates or focuses emanating light into the chamber; and b) actuating a power source which activates the flash lamp and communicates an intense flash through the collimating lens to generate a "light pipe" effect throughout the interior of the hollow shell.

DETAILED DESCRIPTION OF THE INVENTION

The invention herein provides a subcombination of components for achieving amusement or entertainment devices which simulate synchronous sound/laser ray illumination and amplification. The invention is particularly useful when employed in toy devices to impart a futuristic impression to such toys. Examples of the instant amusement assembly are described in the following preferred embodiments in terms of specific toy embodiments employing the inventive synchronous sound/light combination described and claimed herein. However, the concept of synchronous sound/light "laser" simulation set forth herein is applicable to amusement and entertainment items in general. For example, furniture items such as chairs and footstools could be rendered as impact responsive in discharging a "laser" light or "light pipe" effect by employing the instant inventive components.

Figure 1:
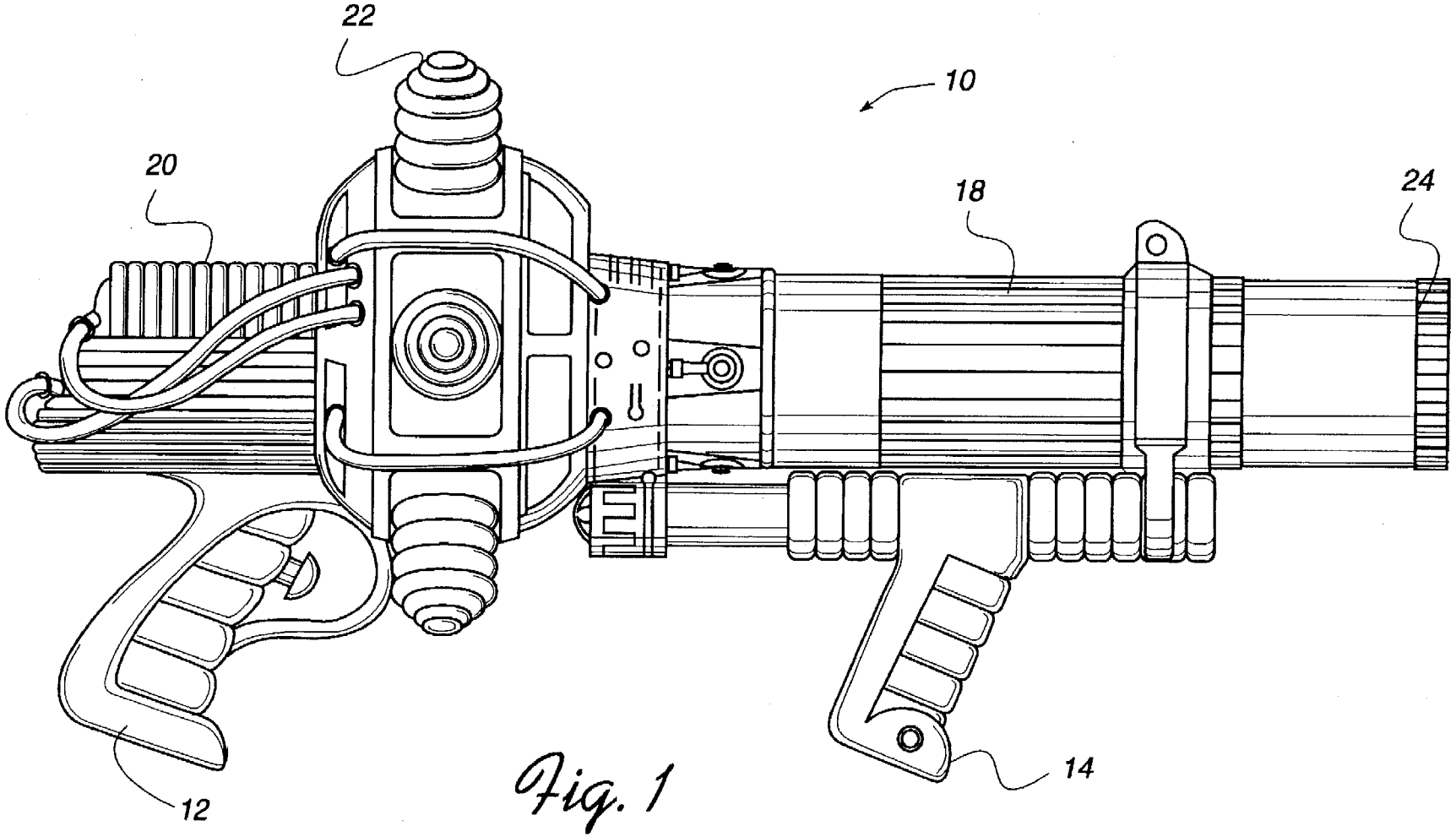
FIG. 1 is a view of a toy gun embodiment employing the sound/light hollow chamber assembly of the present amusement assembly invention.

FIGS. 1 depicts a toy gun 10 as it appears as in one typical configuration in accordance with the invention. In general, it is in the nature of an assault weapon and comprises a hollow structure having two handle potions 12 and 14 adapted to be gripped by the user and attached to a central body portion 16 and a forward end or barrel portion 18. Both handle and body portions may be made from metal or rigid plastic parts that can be molded in the desired shape or prefabricated and assembled by conventional fasteners or bonding materials. In one preferred form the main portions of the body and handle fabricated from aluminum sheet stock are combined with some elements and outer decorative strips of opaque plastic material. However, for reasons to follow, it is to be understood that the barrel portion must at least partially consist of light transparent material. It is otherwise understood that different types of materials and combinations thereof can be utilized within the scope of the invention.

The trigger handle portion 12 is generally rectangular in shape and has a width and thickness which is appropriate to enable it to be held and gripped comfortably. Extending rearwardly from the trigger handle is the rear body section 20 which houses the battery power source more amply demonstrated in FIG. 2. Forwardly from the rear body is the somewhat wider and more ornamental central body section 22 whose outer surface contains extending poles for futuristic design purposes. Extending further forwardly from the central body section is the barrel portion 18 of the body that terminates at a muzzle-like end 24 which is comprised of a tubular chamber containing the impact responsive sound/light assembly of the present invention and described more fully in FIG. 2. Additionally extending forward from the central body is front handle 14 of generally rectangular shape to optimize hand gripping.

Figure 2:
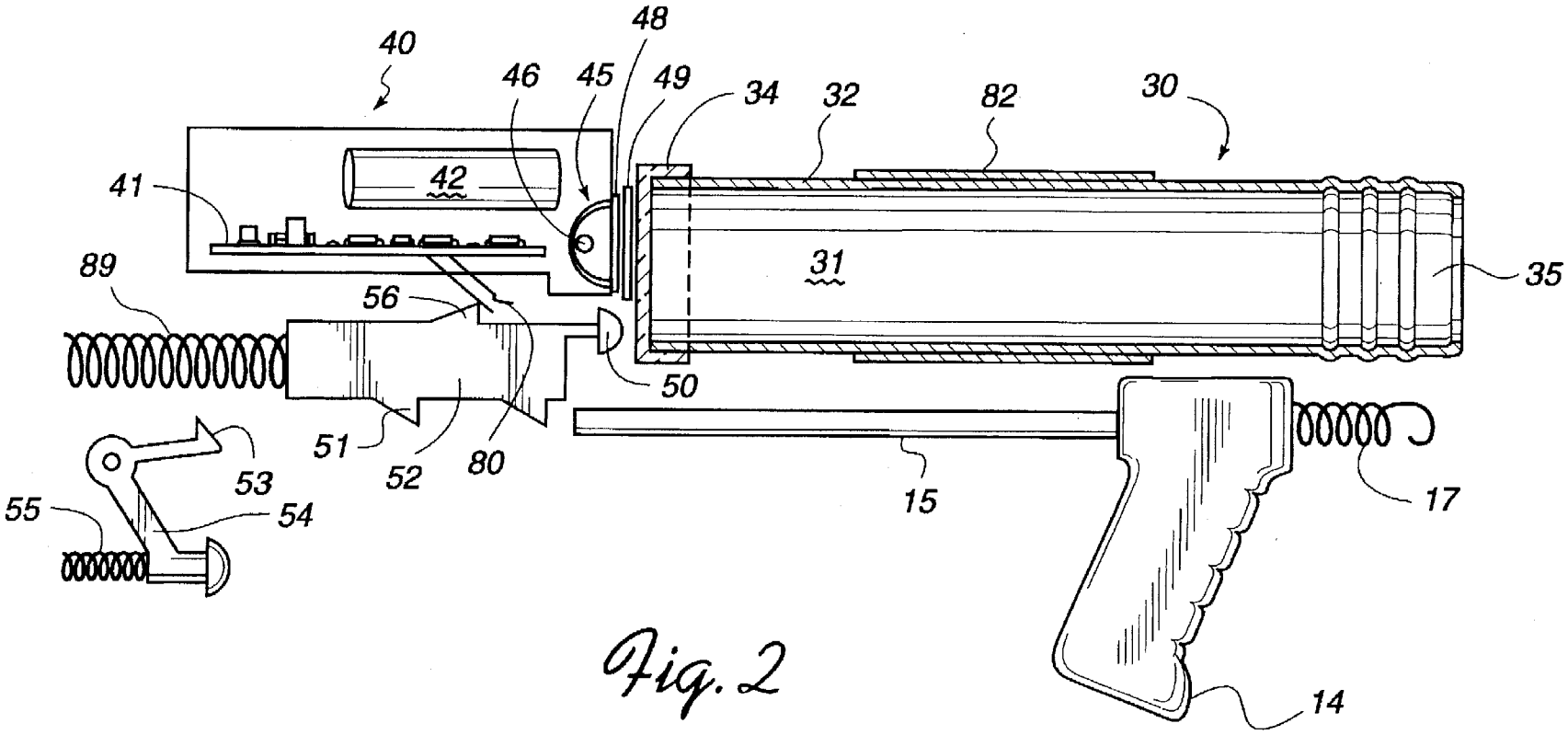
FIG. 2 is a cutaway view of the instant chamber assembly employed in the gun embodiment of FIG. 1.

In FIG. 2, a cutaway segmented schematic of the central subassemblies of the toy gun of FIG. 1 are demonstrated. Front barrel portion 18 of FIG. 1 is shown as item 30 which illustrates a hollow tubular chamber 31 comprised of light transparent material 32 circumferentially encasing the chamber space 31. Rearward of the chamber is an enclosing clear plastic cover 34 tautly drawn over the rear end of the chamber to form a "drumhead" for sound and flash actuation purposes to be explained below. Just rearward and external to the hollow chamber 31 is an encased high voltage power supply source 40 comprised of a circuit 41 and capacitor 42 arrangement connected electrically to a light source arrangement 45 comprised of a high intensity flash bulb or lamp 46 shown partially surrounded by a reflector element 47 to the rear of the bulb and a collimating frontal lens 48 to the front of the bulb/reflector arrangement.

The circuit 41 additionally comprises a curl conductor wire spring switch 80 which is closed by the impact of the trigger release of the propelled plunger 52 (described below). The power source 40 and light assembly 45 are positioned with respect to the barrel portion of the gun so that the light assembly 45 is in communicative alignment so as to effect the channeling of any light from the bulb into the hollow chamber. As shown the frontal lens 48 is placed in parallel disposition to the taut plastic (Mylar) cover to enable sole and direct passage of light into the barrel chamber 31. Further shown is filter element 49 disposed as an interface between the frontal focus lens and the taut plastic cover. The lens is an optional component to the light source assembly, its function being to either colorize or diminish the light entering the chamber. The power unit 40 and flash unit assembly 45 functions as follows: Upon actuation of the flash tube, light is reflected through the lens where it is first filtered by the filter component 49 and focused before entering the open channel space 31 of the chamber.

Also shown in FIG. 2 is plunger assembly 51 which is comprised of a striker element 50, an appended elevated, circuit closing element 56 designed to close loop switch 80 upon impact, and rachet catch 51, the plunger assembly being biased forward by spring 89. In operation, front handle 14 is retracted by hand to cause the rearward movement of trigger element 54 against bias spring 89 to cause a spring biased stop between racheting catch element 51 and trigger finger catch 53 shown in combination with trigger finger 54 which is itself separately spring biased forward by spring 55. When the plunger element 52 is fully retracted against spring 89, rachet stop 51 interlocks with trigger finger catch 53 which is independently biased by spring 55. This force on the trigger leverages trigger finger catch 53 against the bottom surface of plunger 52 to which the striker 50 is connected so that upon retraction of the plunger 52, trigger catch 53 rachet locks with racheting catch element 51 thereby locking the plunger 52 into place subject to release by the trigger. Additionally shown is slide handle 14 affixed to rod 15 and biased forwardly by spring 17 to return handle 14 to a functional frontal position after caulking the plunger 52 to a lock position with trigger 54. Upon finger depression of the trigger, striker 50 plunges forward striking the drumhead 34 to cause both a shooting sound by the plunger 50 striking the drumhead 34 and actuating the circuit contact of the loop wire switch 80 by the impact of this switch by raised ridge 56 thereby actuating the flash unit to illuminate hollow tubular chamber 31.

Described another way, a power switch (not shown) is closed allowing current from power batteries in the gun body (not shown) to flow to a high voltage power supply circuit 41. Capacitor 46 is then charged and slide handle 14 is then pulled back causing actuator rod 15 to push drum plunger 52 against spring 52. The drum plunger is then latched and held in place by trigger catch element 53. Slide handle 14 is then returned to a starting forward position by forward tension spring 17. When trigger finger 54 is depressed, drum plunger 52 is propelled forward by spring 52 causing both the closure of wire loop switch 80 by propelled impact ridge 56 and striker 50 to sound Mylar drum 34 which, in turn, causes current to flow from capacitor 40 to flash tube 36. Consequently, when light is finally emitted from the flash tube, the user experiences a slight delay from the time the trigger is depressed and the sound is heard.

Light emitted from flash tube 46 is focused forward by reflector 47 and passes through clear focusing lens 48 and filter 49, and on through drum head 34 into chamber space 31. A portion of the light exits the open end of clear tube 31 while the remainder enters the sides of the clear tube and light pipe detail 82, which are cylindrical wrapped portions of polished plastic laminated to the barrel portion of the chamber, through which tube and detail the light is displayed in amplified form through the transparent walls of the chamber and the polished plastic.

Figure 3:
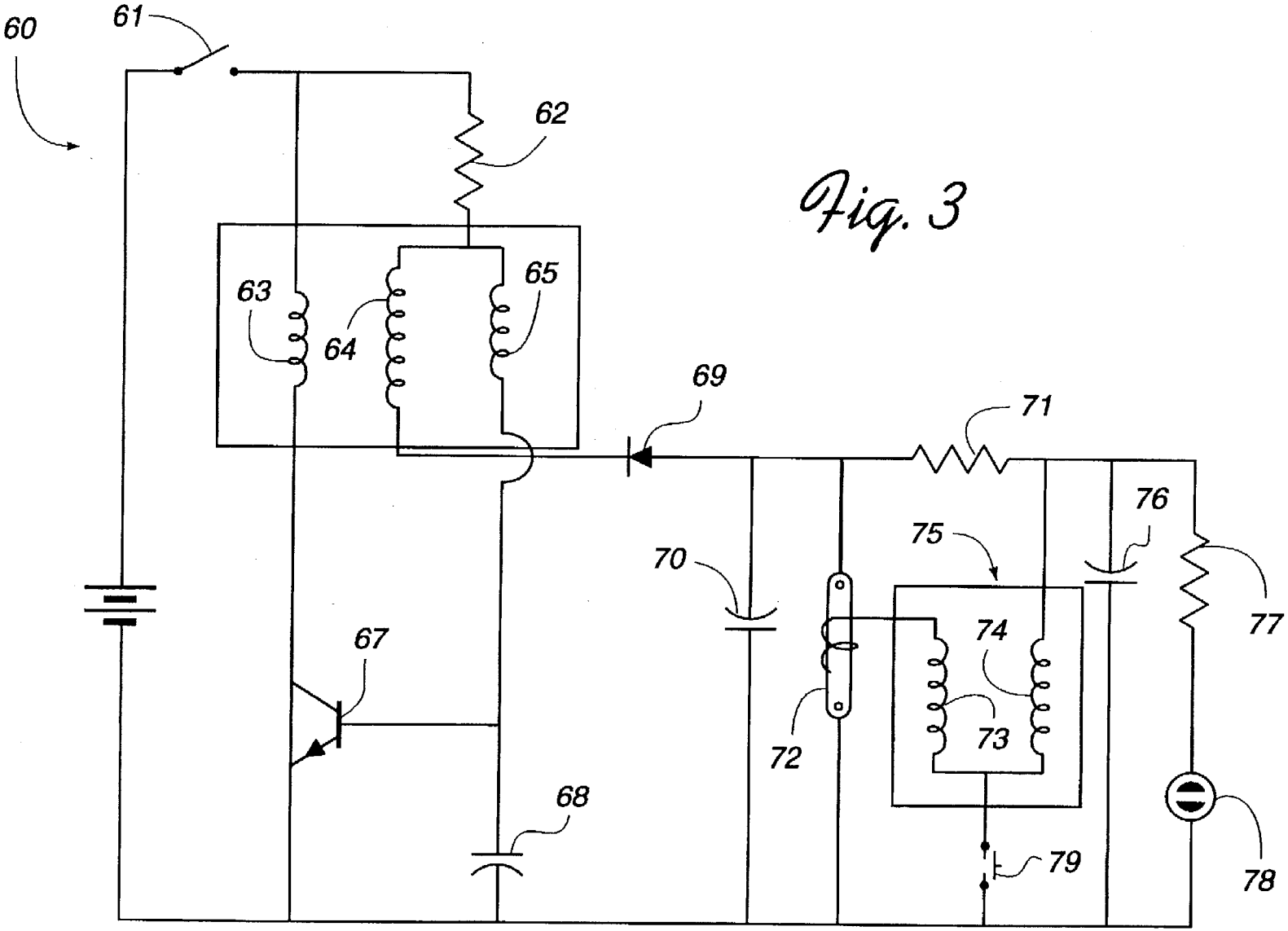
FIG. 3 is a diagram of the control circuit for the flash unit used in the gun embodiment of the instant amusement assembly device.

Turning to FIG. 3 there is demonstrated a control circuit 60 for the instant sound/light assembly. In order to achieve the desired flash from a battery power supply the flash circuit includes a transistorized oscillation stage, a 300 volt capacitor charging circuit, a flash trigger circuit, and a charge indicator light. The oscillation stage is made up of feed winding 66, primary winding 63, NPN transistor 67, capacitor 68 and current limiting resistor 62. Oscillation begins when normally open switch 61 is closed connecting the circuit to the positive terminal of the battery. Secondary winding 64 and primary winding 63 are inductively coupled and, when the circuit is in oscillation, they cause a high voltage alternating current to be generated across winding 64. This high voltage alternating current is then rectified by diode 69 and used to charge capacitor 70. When charged to approximately 300 volts capacitor 70 provides the necessary current to sustain an arc inside the flash tube 72 when it is triggered. The flash triggering circuit includes transformer 75, current limiting transistor 71, capacitor 76 and normally open impact sensing switch 79. When capacitor 70 is fully charged and switch 79 is momentarily closed, capacitor 76 discharges through primary winding 74, which is inductively coupled to secondary winding 73, producing approximately 4000 volts across winding 73. This high voltage is used to trigger flash tube 72. A charge indicator light is also included in the circuit. This light remains off until capacitor 76 has again charged to a high enough voltage to trigger an arc in flash tube 72. The charge indicator light circuit consists of neon lamp 78 and voltage dropping resistor 79.

As indicated above, the instant sound/light assembly and circuit can be used in any number of amusement, entertainment and toy devices. Among the toys contemplated for use with the present invention include: (a) a Flash Gun as described above; (b) a Flash Bat in which an impact switch detects contact with a ball and special internal reflectors in the barrel of the bat enhance the "laser" flash during daylight; (c) a Flash Ball, a clear ball with impact switch fires flashing when ball is caught, struck, dropped or otherwise impacted (A clear housing has phosphorescent detail); (d) a Flash Grenade having an impact pin which may be timed; (e) a Flash Football; a clear housing with foam at pointed ends of the ellipsoidal shell; flashes when kicked, caught or otherwise impacted, (f) Flash Wand, the sound/flash assembly is located in the upper tubular end of a baton; (g) Flash Bazooka, a larger, shoulder mounted version of the flash gun. The instant inventive assembly is used in all these toys with minor variations in switching. All of these toys trigger the "light pipe" flash by means of an impact switch of a simple contact switch. All toys use clear or translucent housings which help to display the flash through light piping effect. Some of the toys use vacuum metalized parts to reflect the flash for amplification and better display of light. Some toys use the high ultraviolet component of the flash to instantly charge phosphorescent parts of the toy.

Figure 4:
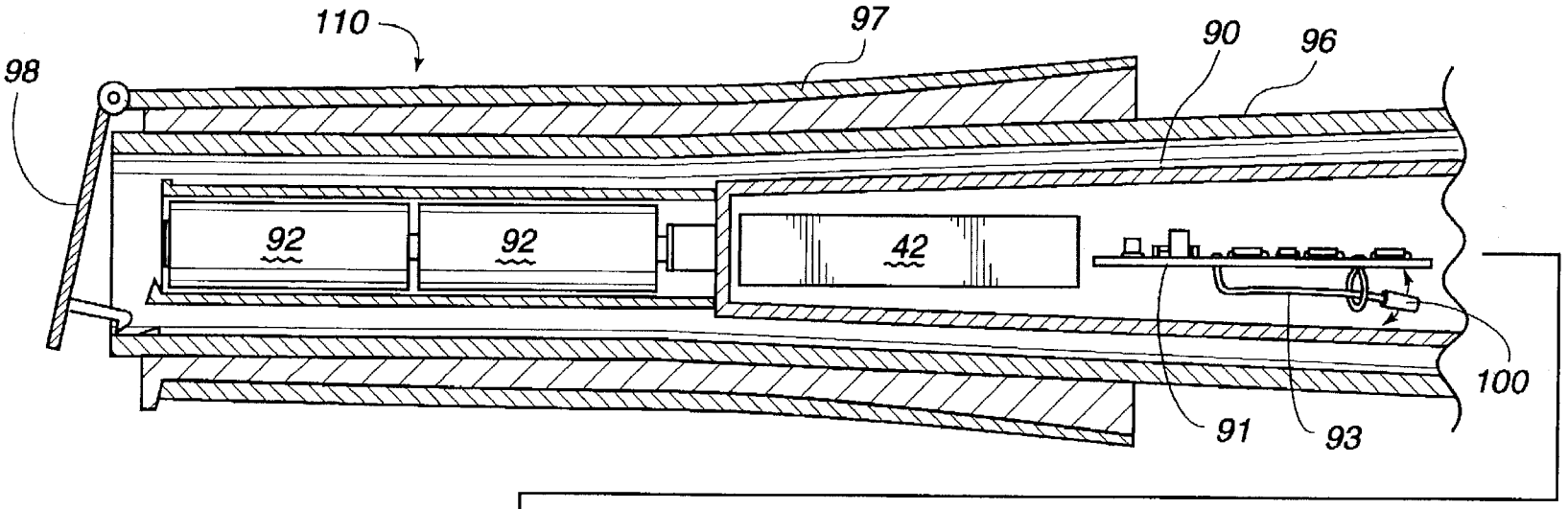
FIG. 4 is a segmented cross sectional view of a baseball bat embodiment of the instant amusement assembly invention.
Figure 4:
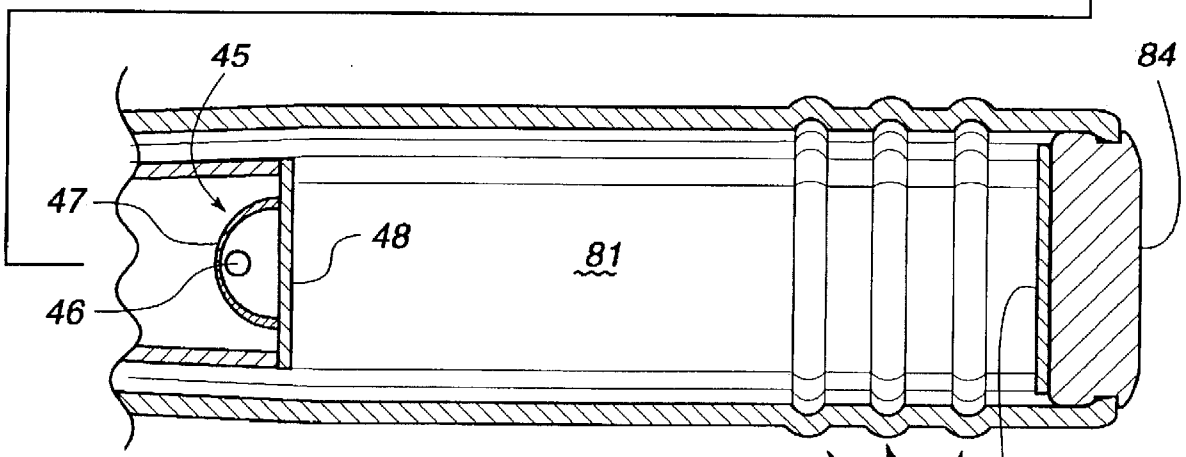

In another embodiment of the present invention, FIG. 4 illustrates the a segmented view of the "Flash Bat" 110 which utilizes the sound/flash assembly of the present invention. At the barrel head end of the bat there is a hollow tubular bore which is a substantially cylindrical compartment 81, one end of which is bordered by the same flash unit assembly 45 of FIG. 1 comprised of a flash tube 46, a parabolic mirror reflector 47, and a clear collimating lens 48 all in communication with the hollow chamber 81, having a mirror 95 at its distal end for reflection of the flashed light back into the chamber resulting in amplification. In the central part of the bat there is a tapered annular channel housing the capacitor and the high voltage power supply 91 in combination with a capacitor 42 and a balancing weight balanced inertial switch also shown. The switch is comprised of a balancing weight 100 at the end of an affixed wire which weight swings with the motion of the bat to make contact with the surrounding conductive metal ring thereby completing the electrical circuit as shown. This inertial switch assembly operates in combination with the same control circuit shown in FIG. 3. The bat performs in the same impact responsive mode as the earlier described gun embodiment, the physical stimulus being the motion of the bat itself or the impacting contact of a ball by the bat either event causes the inertial switch to close activating the flash unit which generates a flash across the chamber 81 simulating a "light pipe" effect.

Also shown in FIG. 4 are electrical dry cell batteries 92 and end cap 84 at the head of the bat to give the bat head a dome effect. Additionally shown is tapered tubular housing 96 which encases the electrical, flash and hollow chamber assemblies. Further shown is tapered sheath 97 which encloses and secures the handle end of the bat but allows access to the batteries by means of a pivoted door 98 at the end of the bat. And further demonstrated are curl reflector elements 99 which reflect the amplified light of chamber 81 to achieve a more dramatic flash effect.

Figure 5:
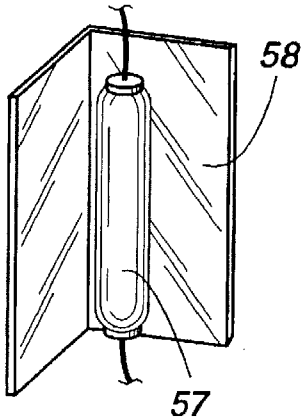
FIG. 5 is an enlarged perspective view of a lamp/reflector assembly used in the present invention.

Turning to FIG. 5 there is demonstrated the reflector 58/bulb 57 combination described in FIGS. 2 and 4. As shown, the bulb or lamp 57 is a xenon bulb in the form of an elongated tube conventionally used in commercial cameras. Xenon bulbs or strobe elements are preferred because of their intense flash which generates the "light pipe" effect so effective in the instant entertainment assemblies. Other strobe light bulbs such as the Long-Life Strobe Tube sold by Radio Shack under inventory No. 272-1145 will be equally effective in the present invention. The reflector 58 is in the form of a perpendicularly intersecting panels (a roof configuration) contrasted with the parabolic shape of the reflectors shown in FIGS. 2 and 4. Any shaped reflector that functions to corral the impinging light and reflect it back to the hollow chambers previously described will function in the instant invention.

Having described the invention, it will be apparent to those skilled in the art that various modifications can be made within the scope of the present invention. For example, the device configurations of the embodiments herein are exemplary and other entertainment or amusement devices can be used.

We claim:

1. An illuminable toy gun having a barrel, trigger and handle assembly comprising:

a) a light transparent hollow chamber in the form of the gun barrel;

b) a light source in communication with the interior of the chamber said light source comprised of (I) a high intensity flash lamp, (ii) a reflector, (iii) a control circuit electrically connected to the lamp and (iv) a lens which collimates or focuses emanating light into the chamber;

c) sensing means in the form of a contact switch which is impact actuated by trigger release of the toy gun; and d) a portable power source electrically connected to the control circuit and responsive to the contact switch for energizing said light source to illuminate the gun barrel chamber.

2. The toy gun of claim 1 wherein the flash lamp is a xenon flash bulb.

3. A method for generating "laser ray" or "pipe light" fictitious light in a toy gun device comprising:

a) providing a light source in communication with the interior of a transparent hollow shell in the form of a gun barrel, said light source comprised of (I) a high intensity flash lamp, (ii) a reflector, (iii) a control circuit electrically connected to the lamp and (iv) a collimating lens to focus emanating light into the interior of the shell; and b) closing a contact switch circuit by the trigger release action of an impact element of the toy gun to actuate a power source which activates the flash lamp and communicates the intense flash through the collimating lens to generate an amplified light throughout the interior of the hollow shell.

4. The method of claim 3 wherein the high intensity flash lamp is a xenon flash bulb.

* * * * *